US011674194B2

(12) United States Patent
Kim et al.

(10) Patent No.: US 11,674,194 B2
(45) Date of Patent: Jun. 13, 2023

(54) COLD ROLLED STEEL SHEET FOR FLUX-CORED WIRE, AND MANUFACTURING METHOD THEREFOR

(71) Applicant: POSCO, Pohang-si (KR)

(72) Inventors: Jai-Ik Kim, Pohang-si (KR); Min-Gwan Seong, Pohang-si (KR); Jin-A Kim, Seoul (KR)

(73) Assignee: POSCO CO., LTD, Pohang-si (KR)

( * ) Notice: Subject to any disclaimer, the term of this patent is extended or adjusted under 35 U.S.C. 154(b) by 207 days.

(21) Appl. No.: 16/628,323

(22) PCT Filed: Jul. 5, 2018

(86) PCT No.: PCT/KR2018/007622
§ 371 (c)(1),
(2) Date: Jan. 3, 2020

(87) PCT Pub. No.: WO2019/009636
PCT Pub. Date: Jan. 10, 2019

(65) Prior Publication Data

US 2020/0149127 A1 May 14, 2020

(30) Foreign Application Priority Data

Jul. 5, 2017 (KR) ..... 10-2017-0085416

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 2211/003; C21D 2211/005
See application file for complete search history.

(56) References Cited

U.S. PATENT DOCUMENTS 4,465,921 A * 8/1984 Sakai ..... B23K 35/3608 219/146.24
2006/0226138 A1 10/2006 James et al.
(Continued)

FOREIGN PATENT DOCUMENTS

CN 101400815 A 4/2009
CN 101808774 A 8/2010
(Continued)

OTHER PUBLICATIONS

Chinese Office Action dated Dec. 18, 2020 issued in Chinese Patent Application No. 201880043414.9.
(Continued)

*Primary Examiner* — Nicholas A Wang
(74) *Attorney, Agent, or Firm* — Morgan, Lewis & Bockius LLP

(57) ABSTRACT

The purpose of one aspect of the present disclosure is to provide: a cold rolled steel sheet for a flux-cored wire, having excellent low temperature toughness, welding workability and processability; and a manufacturing method thereof. One embodiment of the present disclosure provides: a cold rolled steel sheet for a flux-cored wire, comprising, by wt %, 0.005-0.10% of C, 0.05-0.25% of Mn, 0.05% or less of Si (excluding 0%), 0.0005-0.01% of P, 0.008% or less of S (excluding 0%), 0.005-0.06% of Al, 0.0005-0.003% of N, 0.8-1.7% of Ni, 0.1-0.5% of Cr, and a balance of Fe and inevitable impurities, and having 0.10-0.75 of WN defined by Relationship 1 below; and a manufacturing method therefor.

$$WN=(31\times C+0.5\times Mn+20\times Al)\times(Ni)\times(0.6\times Cr).$$ Relationship 1

15 Claims, 2 Drawing Sheets

(a)

(b)

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/40*** | (2006.01) |

(52) U.S. Cl.

CPC ..... *C21D 8/0205* (2013.01); *C21D 8/0226* (2013.01); *C21D 8/0236* (2013.01); *C21D 8/0247* (2013.01); *C22C 38/001* (2013.01); *C22C 38/002* (2013.01); *C22C 38/02* (2013.01); *C22C 38/04* (2013.01); *C22C 38/06* (2013.01); *C22C 38/40* (2013.01); *C21D 2211/003* (2013.01); *C21D 2211/005* (2013.01)

(56) References Cited

U.S. PATENT DOCUMENTS

| | | | |
|---|---|---|---|
| 2009/0025835 | A1 | 1/2009 | Hara et al. |
| 2010/0206130 | A1 | 8/2010 | Nako et al. |
| 2011/0062133 | A1 | 3/2011 | Inoue et al. |
| 2011/0073570 | A1 | 3/2011 | Shimura et al. |
| 2011/0097234 | A1 | 4/2011 | Oikawa et al. |

FOREIGN PATENT DOCUMENTS

| | | | | |
|---|---|---|---|---|
| CN | 101981216 | A | | 2/2011 |
| CN | 102046325 | A | | 5/2011 |
| CN | 106425161 | A | | 2/2017 |
| EP | 1995339 | A1 | | 11/2008 |
| JP | S60-046896 | A | | 3/1985 |
| JP | H01-294822 | A | | 11/1989 |
| JP | H7-9191 | A | | 1/1995 |
| JP | H11-350062 | A | | 12/1999 |
| JP | 2007-009235 | A | | 1/2007 |
| JP | 2007009235 | | * | 1/2007 |
| JP | 2007-144516 | A | | 6/2007 |
| JP | 2009-242858 | A | | 10/2009 |
| JP | 2012-126943 | A | | 7/2012 |
| KR | 2002-0010050 | A | | 2/2002 |
| KR | 10-2006-0107910 | A | | 10/2006 |
| KR | 10-2007-0108564 | A | | 11/2007 |
| KR | 10-1033389 | B1 | | 5/2011 |
| KR | 10-2013-0077072 | A | | 7/2013 |
| KR | 10-1400600 | B1 | | 5/2014 |
| KR | 101400600 | | * | 5/2014 |

OTHER PUBLICATIONS

Japanese Office Action dated Feb. 9, 2021 issued in Japanese Patent Application No. 2019-572190.

International Search Report in International Patent Application No. PCT/KR2018/007622, dated Oct. 15, 2018 with full English translation.

* cited by examiner

[Figure 1]
(a)
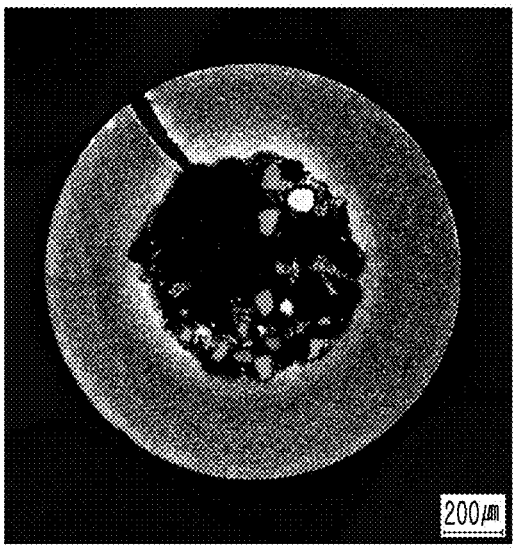
(b)
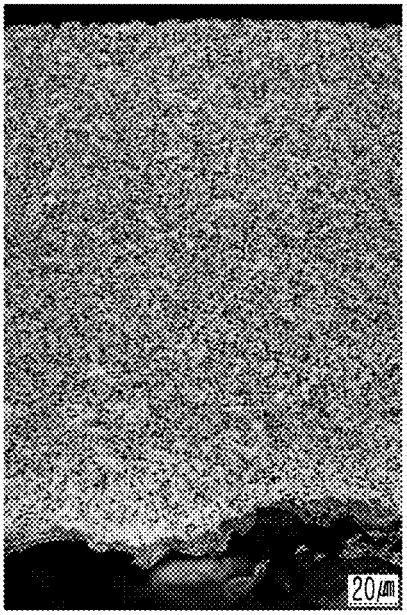

[Figure 2]
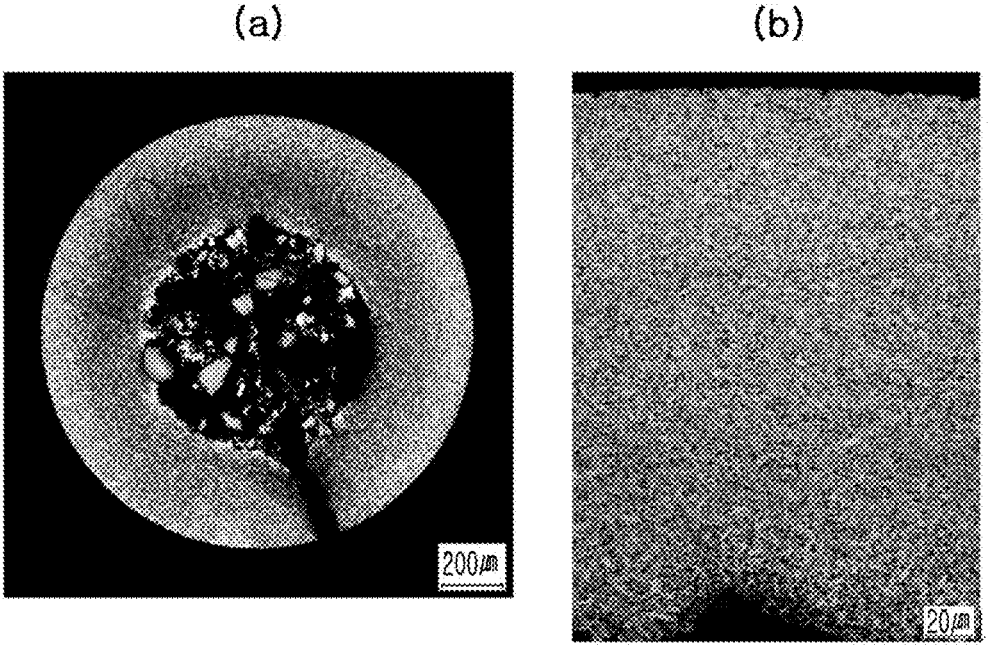

COLD ROLLED STEEL SHEET FOR FLUX-CORED WIRE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2018/007622, filed on Jul. 5, 2018, which in turn claims the benefit of Korean Application No. 10-2017-0085416, filed on Jul. 5, 2017, the entire disclosures of which applications are incorporated by reference herein.

TECHNICAL FIELD

The present invention relates to a cold rolled steel sheet for a flux-cored wire and a manufacturing method thereof.

BACKGROUND ART

In the case of steel strip for welding rods applied to a flux-cored wire, or the like, there have been the development and application of steel sheets applied as raw steel material and flux materials in order to correspond to various purposes of use. There have been the development and application of steel sheets and flux materials to steel strip for welding rods applied to a flux cored wire, and the like, in order to correspond to various purposes of use. There has also been development of welded members for various special purposes, for example, welded members for high manganese steel having excellent abrasion resistance, cryogenic welded members having excellent cryogenic toughness, a welded member for dustproof steel having excellent dustproof performance. In this regard, materials for welding rods corresponding to such steels for special welding have been being developed.

In general, flux-cored welding (FCW) is a welding method having the highest welding productivity and easiest welding in various locations. Materials used in this method are flux-cored wires, and the method involves processing a strip drawn from a conventional cold rolled steel sheet in a U shape and mixing and adding about 5 wt % to 50 wt % of the flux and powder forms of alloying elements such as manganese (Mg), nickel (Ni), and the like, in the processed U-shaped pipe followed by processing and manufacturing the mixture in a circular form. The flux component is added to ensure weldability, and the alloying elements are added to ensure characteristics suitable for use of the welding rods.

Various characteristics required for the welding rod materials are accomplished by changing types and amounts of alloy components added in a core in a powder form. For example, alloying elements for improving cryogenic toughness need to be mixed with the flux and added to a processed wire core portion together with the flux and loaded in order to produce welding members requiring excellent cryogenic toughness.

Meanwhile, general carbon steel not containing a large amount of alloying elements are conventionally used as a cold rolled steel for wires used in manufacturing the flux-cored wires. Stainless steel is in use in some special applications.

A steel for general carbon steel-based wire has excellent elongation and thus is not torn during drawing. Also, due to low work hardening, continuous manufacturing is feasible from forming to manufacturing of final wires without an additional heat treatment. In this regard, the steel for general carbon steel-based wire has been used in various applications by advantage the above mentioned. However, since carbon steel welding steel material is a low-alloy steel, a flux for charging inside of the welding wire and an addition of alloying elements are required to ensure welding rod characteristics according to uses thereof. However, as an appropriate level of flux needs to be added to ensure weldability, there are limitations to increase amounts of alloying elements added to the core. That is, large amounts of oxidants (Ti, Mn, Zr, Al, or the like), slag forming agents ($TiO_2$, $SiO_2$, $Al_2O_3$, $ZrO_2$, MnO, or the like), arc stabilizers (K, Na, or the like) and alloy components (Si, Mn, Ni, Zr, Cr, or the like) need to be added to a center of the wire steel; however, there is a limit that only about 30% to 60% of capacity may be charged in the wire steel material, including the flux. Although there are differences depending on powders, which are charged, the limit is known to be 15% to 25% in weight. In such case, there is a problem in that as a content of an alloying element increases to ensure the characteristics, it may be difficult to ensure stable weldability as the flux component, and the like, are limited. In addition, as the alloying elements are added in a powder form, the core component melted during welding causes segregation in the welded portion, thereby causing welding failure.

As stainless steel for a welding wire conventionally includes larger amounts of alloying elements such as nickel (Ni), chromium (Cr), or the like, present in a steel component, compared to conventional carbon steel, an amount of a core alloying element added together with the flux may be reduced. However, because the stainless steel is basically a high-alloy material and high costs, the stainless steel may only be applied to special purposes of use. Besides, in the case of stainless welding raw steel material, wire breakage is highly likely to occur due to work hardening when processing welding rod wires, which requires additional annealing heat treatment between manufacturing processes, and may cause increased manufacturing costs.

Currently, as for steel for cryogenic welding wire requiring drawability and low temperature toughness, high-cost alloying elements are manufactured in a powder form having high purity and introduced together with other flux components to improve low temperature toughness when the flux is charged after pipemaking using conventional carbon steel. In this case, however, the added alloy powder is highly pure and expensive, and thus has a problem in that there are limitations on the addition of the flux components to ensure welding stability due to large amounts of the added flux components. Moreover, the expensive alloying elements cause segregation in the flux and thus are partially concentrated in the welding rod, thereby giving rise to deteriorated workability such as tearing, and the like, during welding rod processing.

Accordingly, there has been demand for development of steel for welding wires having excellent low temperature toughness and weldability to be preferably applied to a cryogenic environment. For example, to secure characteristics of a cold rolled steel sheet for a flux-cored wire, which is appropriate for cryogenic use, there have been efforts being made to achieve elongation of at least 40%, a welded portion segregation index of less than 0.15%, and an impact energy value of at least 50 J at −40° C.

For example, Patent Document 1 discloses a method for manufacturing steel for a welding rod having excellent impact toughness and strength by adding Cr, Mo, Ti, and the like, to steel containing 1.4% to 2.4% of Mn, 0.2% to 0.4% of Si and 2.8% to 6.4% of Ni. Patent Document 1, however, has a problem of high manufacturing costs as large amounts of expensive alloying elements are comprised. Although high strength can be achieved by adding the alloying elements, ductility is low, thereby making it difficult to obtain drawability.

In addition, Patent Document 2 discloses technology of reducing welding defects by adding Ti, Mg, or the like, to a flux raw material and accelerating deoxidation of a molten metal. To ensure sufficient deoxidation effect of the molten metal, large amounts of alloying elements need to be added to the flux. When such large amounts of the alloying elements are added to the flux, however, there may be a problem in that spatter, a phenomenon in which fine particles splash around during welding, thereby deteriorating weldability.

Therefore, there is a need to develop a welded steel strip using a cold rolled steel sheet for a flux-cored wire having excellent weldability and drawability and capable of securing a welded portion having excellent low temperature toughness in a cryogenic environment.

PRIOR ART (Patent Document 1) Korean Laid-Open Publication Application No. 2006-107910

(Patent Document 2) Japanese Laid-Open Publication Application No. 60-46896

DISCLOSURE

Technical Problem

An aspect of the present disclosure cold rolled steel sheet for a flux-cored wire having excellent low temperature toughness, and a manufacturing method thereof.

Meanwhile, the technical problem of the present disclosure is not limited to the above. The technical problem of the present disclosure will be clearly understood by those skilled in the art through the following description without difficulty.

Technical Solution

An aspect of the present disclosure provides a cold rolled steel sheet for a flux-cored wire, containing, by wt %: 0.005% to 0.10% of carbon (C), 0.05% to 0.25% of manganese (Mn), 0.05% or less of silicon (Si) (excluding 0%), 0.0005% to 0.01% of phosphorus (P), 0.008% or less of sulfur (S) (excluding 0%), 0.005% to 0.06% of aluminum (Al), 0.0005% to 0.003% of nitrogen (N), 0.8% to 1.7% of nickel (Ni), 0.1% to 0.5% of chromium (Cr), and a balance of iron (Fe) and inevitable impurities, and having 0.10 to 0.75 of $W_N$ defined by Relationship 1 below, $$W_N=(31\times C+0.5\times Mn+20\times Al)\times(Ni)\times(0.6\times Cr), \quad \text{Relationship 1}$$

where a unit for a content of each element in Relationship 1 is weight %.

Another aspect of the present disclosure provides a method for manufacturing a cold rolled steel sheet, including heating a slab comprising, by wt %, 0.005% to 0.10% of C, 0.05% to 0.25% of Mn, 0.05% or less of Si (excluding 0%), 0.0005%-0.01% of P, 0.008% or less of S (excluding 0%), 0.005% to 0.06% of Al, 0.0005% to 0.003% of N, 0.8% to 1.7% of Ni, 0.1% to 0.5% of Cr, and a balance of Fe and inevitable impurities, and having 0.10 to 0.75 of $W_N$ defined by Relationship 1 below to 1100° C. to 1300° C.; hot rolling the heated slab such that a finish rolling temperature is 880° C. to 950° C. to obtain a hot rolled steel sheet; coiling the heated hot rolled steel sheet in a temperature range of 550° C. to 700° C.; cold rolling the coiled hot rolled steel sheet at a rolling reduction ratio of 50% to 85% to obtain a cold rolled steel sheet; and continuously annealing the cold rolled steel sheet in a temperature range of 700° C. to 850° C., $$W_N=(31\times C+0.5\times Mn+20\times Al)\times(Ni)\times(0.6\times Cr), \quad \text{Relationship 1}$$

where a unit for a content of each element in Relationship 1 is weight %.

The technical solutions above are not all features of the present disclosure. Various features of the present disclosure and advantages and effects thereof can be understood in more detail with reference to the following specific embodiments.

Advantageous Effects

According to an aspect of the present disclosure, the present disclosure can provide a cold rolled steel sheet for a flux-cored wire having excellent low temperature toughness, weldability and workability to provide a welding rod for a flux-cored wire capable of all position welding, used in the shipbuilding, materials and construction industries.

BRIEF DESCRIPTIONS OF DRAWINGS

FIG. 1 is a photographic image of a microstructure of Inventive Example 2 in Example of the present disclosure; (a) is a photographic image of a flux-cored wire manufactured using Inventive Example 2, and (b) is an enlarged image of a sheath of (a).

FIG. 2 is a photographic image of a microstructure of Comparative Example 5 in Example of the present disclosure; (a) is a photographic image of a flux-cored wire manufactured using Comparative Example 5, and (b) is an enlarged image of a sheath of (a).

BEST MODE

Preferred embodiments of the present disclosure will now be described. However, the present disclosure may be embodied in many different forms and should not be construed as being limited to the embodiments set forth herein. Rather, these embodiments are provided so that this disclosure will be thorough and complete, and will fully convey the scope of the disclosure to those skilled in the art.

Hereinafter, a cold rolled steel sheet for a flux-cored wire will be described in detail.

The cold rolled steel sheet for a flux-cored wire of the present disclosure includes, by wt %, 0.005% to 0.10% of C, 0.05% to 0.25% of Mn, 0.05% or less of Si (excluding 0%), 0.0005%-0.01% of P, 0.008% or less of S (excluding 0%), 0.005% to 0.06% of Al, 0.0005% to 0.003% of N, 0.8% to 1.7% of Ni, 0.1% to 0.5% of Cr, and a balance of Fe and inevitable impurities, and having 0.10 to 0.75 of $W_N$ defined by Relationship 1 below.

The alloy composition of the present disclosure will be described in detail. In the following description, the unit of a content of each element is given in wt %, unless otherwise indicated.

C: 0.005% to 0.10%

Carbon (C) is an element conventionally added to improve strength of steel and to make a weld heat affected zone of have similar characteristics to a base material. When C is contained in an amount of less than 0.005%, said effects may not be sufficiently achieved. In contrast, when C is contained in an amount exceeding 0.10%, problems such as wire breakage may occur during a drawing process due to high strength or work hardening. Further, it is disadvantageous that low temperature cracking or reduced impact toughness may occur in a welding joint, and multiple heat treatments may be required to process a final product due to high hardness. Accordingly, the C content is preferably 0.005% to 0.10%, and in order to improve the characteristics of the weld heat-affected zone, it may more preferably be 0.01 to 0.06%.

Mn: 0.05% to 0.25%

Manganese (Mn), as a solid solution strengthening element, increases strength of steel and improves hot rolling workability. When an excessive amount of Mn is added, a large amount of manganese-sulfide (MnS) precipitates are formed, thereby reducing ductility and workability of the steel. An amount of Mn less than 0.05%, may cause red shortness and makes it difficult to contribute to austenite stabilization. In contrast, a Mn amount exceeding 0.25% may reduce ductility and cause center segregation, thereby inducing wire breakage may occur during the drawing process. In this regard, the amount of Mn may preferably be 0.05% to 0.25%, more preferably 0.06% to 0.24%.

Si: 0.05% or less (excluding 0%)

Silicon (Si) binds to oxygen, or the like, and forms an oxide layer, thereby reducing surface quality and corrosion resistance. Si also accelerates transformation of a hard phase in a welded metal, thereby deteriorating low temperature toughness characteristics. In this regard, the amount of Si is limited preferably to 0.05% or less, more preferably 0.04% or less.

P: 0.0005% to 0.01%

Phosphorus (P) is an element present as a solid solution element in steel and improving strength and hardness of steel by causing solid solution strengthening. It is preferable that P be added in an amount of at least 0.0005% to maintain a predetermined level of rigidity. When P is contained in an amount exceeding 0.01%, center segregation may occur during casting, and ductility may be lowered, thereby deteriorating wire workability. Accordingly, P is preferably added in an amount of 0.0005% to 0.01%, more preferably 0.001% to 0.009%.

S: 0.008% or less (excluding 0%)

Sulfur (S) is a factor forming non-metallic inclusions by combining with Mn and causing red shortness. In this regard, it is preferable to reduce an S content to be as low as possible. Further, when a large amount of S is contained, toughness of a base material of a steel sheet may be reduced. Accordingly, the S content is preferably 0.008% or less, more preferably 0.0075% or less.

Al: 0.005% to 0.06%

Aluminum (Al) is an element added to aluminum-killed steel to prevent deterioration of a material caused by a deoxidizer and aging and advantageous in ensuring ductility. Such effects are more significant at an extremely low temperature. When Al is contained in an amount of less than 0.005%, said effects are insufficiently achieved. In contrast, an Al amount exceeding 0.06% sharply increases surface inclusions such as aluminum-oxide ($Al_2O_3$), thereby deteriorating surface characteristics of a hot-rolled material and workability. Further, ferrite may be locally formed in grain boundaries of the weld heat-affected zone, thereby deteriorating mechanical properties, and a shape of beads may be deteriorated after welding. Accordingly, the Al amount is preferably 0.005% to 0.06%, more preferably, 0.007% to 0.050%.

N: 0.0005% to 0.003%

Nitrogen (N) is an element present in a solid solution state in steel and is effective for strengthening a material. To ensure target rigidity, it is necessary to add 0.0005% or more of N. In contrast, when an N content exceeds 0.003%, not only are the aging characteristics drastically deteriorated, but also a burden due to denitrification is increased in manufacturing processes of the steel, thereby deteriorating steelmaking workability. Accordingly, the N content is preferably 0.0005% to 0.003%, more preferably 0.008% to 0.0029%.

Ni: 0.8% to 1.7%

Nickel (Ni) is an element effective in improving ductility to improve drawability and necessary to form a stable structure at extremely low temperatures to improve low-temperature toughness characteristics. It is necessary to include Ni in an amount of at least 0.8% to achieve such effects and stably operate a flux composition. In contrast, when Ni is added in an amount greater than 1.7%, drawability may be deteriorated due to increased strength and surface defects may occur. In addition, as Ni is an expensive element, manufacturing costs may increase. Accordingly, the Ni content is preferably 0.8% to 1.7%, more preferably 0.085% to 1.65%.

Cr: 0.1% to 0.5%

Chromium (Cr) is an element favorable to strength of a welding joint and serves to form a stable rust layer to contribute to improving corrosion resistance. In order to secure such effects, Cr is preferably added in an amount of 0.1% or more. In contrast, when Cr is added in an amount exceeding 0.5%, Cr-based carbides are formed and cause brittleness, which may result in poor workability. Accordingly, the Cr content preferably satisfies 0.1% to 0.5%, more preferably 0.13% to 0.45%.

The remaining ingredient of the cold rolled steel sheet of the present disclosure is Fe; however, in conventional manufacturing processes, undesired impurities from raw materials or manufacturing environments may be inevitably mixed, and thus cannot be excluded. Such impurities are well-known to those of ordinary skill in the art, and thus, specific descriptions thereof will not be mentioned in the present disclosure.

Meanwhile, the cold rolled steel sheet of the present disclosure satisfies the alloy composition previously described, and it is preferable that $W_{FC}$ defined by Relationship 1 below be 0.10 to 0.75. A unit of a content of each element in Relationship 1 is weight %, $$W_N=(31\times C+0.5\times Mn+20\times Al)\times(Ni)\times(0.6\times Cr). \quad \text{Relationship 1}$$

Relationship 1 is designed in consideration of a correlation of each element to weldability and drawability. When $W_N$ is less than 0.10, it may be advantageous in terms of workability in due to an insignificant amount of transformation of a room temperature structure into a hard phase. In order to secure low temperature toughness, however, weldability may be deteriorated in accordance with an increased amount of alloy added as an alloying element of a flux. In contrast, when the $W_N$ is greater than 0.75, a fraction of the hard-transformed structure increases, which may give rise to problems that breakage of a welded member occurs at the time of pipemaking and drawing, as well as increased manufacturing costs due to an addition of a large amount of expensive alloying elements. Accordingly, $W_N$ satisfies preferably 0.10 to 0.75, more preferably 0.11 to 0.73.

Meanwhile, it is preferable that the cold rolled steel sheet has a microstructure containing, by area %, 1% to 6% of cementite and a balance of ferrite. A fraction of the cementite less than 1% may act as a factor inducing deformation aging defects caused by solid solution elements in steel as precipitation of carbides is not accelerated. In contrast, the fraction of cementite exceeding 6% may cause cracking during drawing and causes deterioration of resistance corrosion. Accordingly, the fraction of cementite is preferably in the range of 1% to 6%, more preferably in the range of 1.3% to 5.8%.

The cold rolled steel sheet according to the present disclosure may have elongation of 40% or more. By satisfying such properties, the cold rolled steel sheet may be preferably applied as a flux-cored wire material. When the elongation is less than 40%, a cross-sectional reduction rate decreases during welding wire drawing, thereby causing deteriorated pipe workability and cracking such as tearing.

Further, the cold rolled steel sheet manufactured according to the present disclosure may have a segregation index of a welded portion less than 0.15% and an impact energy of 50 J or greater at −40° C. More specifically, the segregation index refers to a segregation index of a welded portion welded using a flux-cored wire manufactured using the cold rolled steel sheet according to the present disclosure and is represented by a ratio of an area occupied by segregation by the added elements to a total area of the welded portion. When segregation occurs in the welded portion, stress is concentrated in the segregation portion during processing, which may cause fracturing. In order to prevent tearing due to segregation of the welded portion during second processing after welding, the segregation index of the welded portion is preferably 0.15% or less, more preferably 0.125% or less. Convention flux-cored wires have a problem of an increased segregation index according to an addition of an element such as Ni as an alloying element of the flux, not the base material, to secure low temperature toughness. In the case of the cold rolled steel sheet of the present disclosure, however, segregation-inducing factors are significantly reduced, thereby enabling to secure the segregation index of the welded portion as 0.15% or less. Further, it is necessary to secure the impact energy of 50 J or greater at −40° C. during an impact experiment evaluating low temperature stability of a welding rod. When an impact energy obtained during the experiment at −40° C. falls below 50 J, the welded portion may have cracks due to a low temperature shock in a low-temperature environment and may have a safety issue. In this regard, at least 50 J needs to be secured. It is more preferable that the low temperature impact energy be 55 J or above at −40° C.

Herein below, a method for manufacturing the cold rolled steel sheet for a flux-cored wire of the present disclosure will be described in detail.

The method for manufacturing the cold rolled steel sheet for a flux-cored wire of the present disclosure includes heating the slab satisfying the previously described alloy composition to 1100° C. to 1300° C.; hot rolling the heated slab such that a finish rolling temperature is 880° C. to 950° C. to obtain a hot rolled steel sheet; coiling the heated hot rolled steel sheet in a temperature range of 550° C. to 700° C.; cold rolling the coiled hot rolled steel sheet at a rolling reduction ratio of 50% to 85% to obtain a cold rolled steel sheet; and continuously annealing the cold rolled steel sheet in a temperature range of 700° C. to 850° C.

The slab is heated to 1100° C. to 1300° C. This is to allow the subsequent hot rolling process to be smoothly carried out and to homogenize the slab. When the slab-heating temperature is below 1100° C., a load may drastically increase during the subsequent hot rolling, whereas the temperature exceeding 1300° C. increases not only energy costs but also an amount of surface scale, thereby leading to loss of materials. Accordingly, the slab-heating temperature is preferably 1100° C. to 1300° C., more preferably 1150° C. to 1280° C.

The heated slab is hot-rolled such that a hot finish rolling temperature reaches 880° C. to 950° C. to obtain a hot rolled steel sheet. When the finish rolling temperature is less than 880° C., hot rolling is terminated in a low temperature region, resulting in reduction of hot rolling properties and workability due to rapid granulation of grains. In contrast, when the finish rolling temperature exceeds 950° C., hot rolling is not carried out uniformly over an entire thickness, which gives rise to insufficient refinement of the grains. This may result in reduced impact toughness due to the increased grain size.

The hot rolled steel sheet is then coiled in a temperature range of 550° C. to 700° C. The cooling of the hot-rolled steel sheet before the coiling after the hot rolling may be carried out on a run-out-table (ROT). When the coiling temperature is less than 550° C., behavior formation of the low-temperature precipitates vary during cooling and maintaining due to temperature discrepancy and deviations in mechanical properties are induced, thereby negatively affecting workability. In contrast, when the coiling temperature is above 700° C., a structure of a final product is coarsened, and problems of softened surface material and deteriorated pipe workability may arise. Accordingly, the coiling temperature is preferably 550° C. to 700° C., more preferably 555° C. to 690° C.

The coiled hot-rolled steel sheet is cold-rolled at a rolling reduction ratio of 50% to 85% to obtain a cold rolled steel sheet. When the reduction ratio is less than 50%, driving force for recrystallization is low, and local structure growth occurs, thereby making it difficult to obtain a uniform material. Further, a thickness of the hot rolled steel sheet needs to be reduced considering a thickness of the final product, and this may significantly deteriorate the hot rolling workability. In contrast, when the reduction ratio exceeds 85%, the material solidifies and causes cracking during the drawing. Moreover, the cold rolling workability is reduced due to a load of a rolling mill. Accordingly, the rolling reduction ratio is preferably 50% to 85%, more preferably 65% to 80%.

Pickling of the coiled hot rolled steel sheet may further be included before cold rolling.

To ensure workability and rigidity, the cold rolled steel sheet is continuously annealed. Annealing to remove deformation is carried out in a state in which the strength is increased by the deformation introduced during the cold rolling, thereby ensuring target strength and workability. The continuous annealing may be carried in a temperature range of 700° C. to 850° C. At an annealing temperature below 700° C., deformation formed by the cold rolling is not sufficiently removed, thereby significantly deteriorating the workability. In contrast, at an annealing temperature exceeding 850° C., passability of the continuous annealing furnace may be problematic due to high temperature annealing. Accordingly, the continuous annealing temperature is preferably 700° C. to 850° C., more preferably 730° C. to 845° C.

Skin-pass rolling of the continuously annealed cold rolled steel sheet may further be included. The cold rolled steel sheet may be used in manufacturing of welding wires after skin-pass rolling.

MODE FOR INVENTION

Hereinafter, the present disclosure will be described more specifically through the following exemplary examples. However, the exemplary examples are for clearly explaining the present disclosure and are not intended to limit the scope of the present disclosure.

Examples

After heating a slab having a component composition shown in Table 1 below to 1250° C., a cold rolled steel sheet was manufactured under the manufacturing conditions described in Table 2 below. A microstructure of the cold rolled steel sheet was observed to have a ferrite structure. The cold rolled steel sheet was measured in terms of a type, a fraction, elongation, passability and drawability of the microstructure, and the results are shown in Table 3 below. The symbol "o" indicates passability of the case in which there was no rolling load during cold and hot rolling and there was no defect such as heat buckling during continuous annealing. The symbol "x" indicates passability of the case in which there was a rolling load or a defect such as heat buckle when continuous annealing. The drawability was indicated as "bad" for the case when there was a processing defect, such as tearing, during drawing of the flux-cored wire at a cross-sectional reduction ratio of 61%, and as "fine" for the case in which there was no defect occurred.

The manufactured cold rolled steel sheet was utilized to manufacture a strip having a width of 14 mm. The strip was then bent and charged with the flux and the alloy components to manufacture a welding material having a diameter of 3.1 mm. Thus-manufactured welding material was drawn to manufacture a flux-cored wire having a diameter of 1.2 mm and was then subject to a low temperature impact experiment. The result is shown in Table 3 below.

In addition, a segregation index of the welded portion of a welded member welded with the flux-cored wire was measured, and a result thereof is shown in Table 3 below. The result is for the experiment carried out for a welded member drawn with a wire having a diameter of 1.4 mm and manufactured using a pilot (Pilot) welder at a voltage of 29V, current of 150 A to 180 A, and a welding speed of 14 cm/min.

TABLE 1

| | Alloy composition (wt %) | | | | | | | | | |
|---|---|---|---|---|---|---|---|---|---|---|
| Steel | C | Mn | Si | P | S | Al | N | Ni | Cr | $W_N$ |
| IS 1 | 0.014 | 0.13 | 0.011 | 0.006 | 0.005 | 0.021 | 0.0022 | 0.92 | 0.24 | 0.122 |
| IS 2 | 0.018 | 0.07 | 0.009 | 0.008 | 0.002 | 0.014 | 0.0013 | 1.23 | 0.41 | 0.264 |
| IS 3 | 0.047 | 0.12 | 0.008 | 0.005 | 0.004 | 0.009 | 0.0027 | 1.48 | 0.16 | 0.241 |
| IS 4 | 0.035 | 0.23 | 0.011 | 0.004 | 0.006 | 0.034 | 0.0018 | 1.63 | 0.35 | 0.644 |
| IS 5 | 0.064 | 0.21 | 0.021 | 0.003 | 0.003 | 0.028 | 0.0011 | 1.13 | 0.28 | 0.503 |
| CS 1 | 0.003 | 0.14 | 0.008 | 0.006 | 0.006 | 0.025 | 0.0024 | 0.43 | 0 | 0 |
| CS 2 | 0.036 | 0.03 | 0.014 | 0.009 | 0.004 | 0.038 | 0.0014 | 0.09 | 0.19 | 0.019 |
| CS 3 | 0.049 | 0.2 | 0.011 | 0.008 | 0.016 | 0.019 | 0.0029 | 0 | 0.29 | 0 |
| CS 4 | 0.028 | 0.118 | 0.009 | 0.032 | 0.005 | 0.084 | 0.0068 | 1.03 | 0.92 | 1.500 |
| CS 5 | 0.016 | 0.21 | 0.024 | 0.006 | 0.007 | 0.027 | 0.0022 | 2.21 | 0.03 | 0.045 |
| CS 6 | 0.164 | 0.84 | 0.352 | 0.009 | 0.004 | 0.036 | 0.0023 | 0.98 | 1.42 | 5.197 |

$W_N = (31 \times C + 0.5 \times Mn + 20 \times Al) \times (Ni) \times (0.6 \times Cr)$

*IS: Inventive Steel
**CS: Comparative Steel

TABLE 2

| Type | Steel No. | Reheating temp (° C.) | Finish rolling temp (° C.) | Coiling temp (° C.) | Cold rolling reduction rate (%) | Annealing temp (° C.) |
|---|---|---|---|---|---|---|
| IE 1 | IS 1 | 1250 | 900 | 660 | 68 | 750 |
| IE2 | | 1250 | 900 | 660 | 75 | 800 |
| IE3 | | 1250 | 900 | 660 | 78 | 820 |
| IE4 | IS 2 | 1250 | 890 | 560 | 75 | 780 |
| IE5 | | 1250 | 890 | 560 | 75 | 840 |
| IE6 | IS 3 | 1250 | 925 | 640 | 70 | 780 |
| IE7 | IS 4 | 1250 | 930 | 620 | 78 | 780 |
| IE8 | IS 5 | 1250 | 910 | 680 | 72 | 780 |
| IE9 | | 1250 | 910 | 680 | 72 | 830 |
| CE 1 | IS 1 | 1250 | 780 | 660 | 75 | 580 |
| CE 2 | | 1250 | 900 | 660 | 40 | 750 |
| CE 3 | IS 2 | 1250 | 890 | 500 | 90 | 820 |
| CE 4 | IS 3 | 1250 | 925 | 720 | 70 | 880 |
| CE 5 | CS1 | 1250 | 920 | 660 | 75 | 820 |
| CE 6 | CS2 | 1250 | 900 | 660 | 70 | 820 |
| CE 7 | CS3 | 1250 | 900 | 660 | 70 | 820 |
| CE 8 | CS4 | 1250 | 900 | 660 | 70 | 800 |
| CE 9 | CS5 | 1250 | 910 | 660 | 70 | 800 |
| CE 10 | CS6 | 1250 | 890 | 580 | 48 | 800 |

*IE: Inventive Example,
**CE: Comparative Example,
***IS: Inventive Steel,
****CS: Comparative Steel

TABLE 3

| Type | Cementite fraction (area %) | Passability | Elongation (%) | Welded portion segregation index (%) | Impact toughness (J, @−40° C.) | Drawability |
|---|---|---|---|---|---|---|
| IE 1 | 3.5 | ○ | 44 | 0.08 | 65 | Fine |
| IE 2 | 3.1 | ○ | 47 | 0.09 | 58 | Fine |
| IE 3 | 1.6 | ○ | 46 | 0.11 | 63 | Fine |
| IE 4 | 3.8 | ○ | 44 | 0.07 | 92 | Fine |
| IE 5 | 2.5 | ○ | 47 | 0.08 | 85 | Fine |
| IE 6 | 4.7 | ○ | 42 | 0.03 | 87 | Fine |
| IE 7 | 4.0 | ○ | 45 | 0.05 | 104 | Fine |
| IE 8 | 5.3 | ○ | 41 | 0.06 | 97 | Fine |
| IE 9 | 3.8 | ○ | 45 | 0.09 | 113 | Fine |

TABLE 3-continued

| Type | Cementite fraction (area %) | Passability | Elongation (%) | Welded portion segregation index (%) | Impact toughness (J, @−40° C.) | Drawability |
|---|---|---|---|---|---|---|
| CE 1 | 0.4 | x | 25 | 0.09 | 43 | Bad |
| CE 2 | 6.4 | x | 33 | 0.08 | 61 | Bad |
| CE 3 | 0.9 | x | 36 | 0.13 | 45 | Bad |
| CE 4 | 6.8 | x | 44 | 0.17 | 39 | Fine |
| CE 5 | 0.1 | ○ | 42 | 0.53 | 41 | Bad |
| CE 6 | 2.3 | ○ | 38 | 0.34 | 31 | Bad |
| CE 7 | 3.1 | ○ | 36 | 0.42 | 35 | Bad |
| CE 8 | 2.8 | ○ | 33 | 0.21 | 46 | Bad |
| CE 9 | 0.7 | ○ | 37 | 0.46 | 28 | Bad |
| CE 10 | 7.8 | x | 26 | 0.64 | 33 | Bad |

*IE: Inventive Example,
**CE: Comparative Example

As shown in Tables 1 to 3 above, Inventive Examples satisfying all of the alloy composition and manufacturing conditions proposed in the present disclosure have not only fine passability but also target elongation of 40% or more, a material standard of the cold rolled steel sheet for a flux-cored wire. The segregation index of the wire manufactured as the welded member was less than 0.15%. In this regard, no tearing or cracking occurred in the welded portion during second processing, thereby securing excellent workability. In addition, the impact energy was at least 50 J at −40° C., thus securing excellent low temperature toughness.

In contrast, Comparative Examples 1 to 4 satisfied the alloy composition suggested in the present disclosure but not the manufacturing conditions and had problems of deteriorated rolling passability (Comparative Examples 1 to 3) and annealing passability (Comparative Example 4). It was also confirmed that elongation was lower than the target elongation, the impact energy was −50 J at −40° C., and the drawability was poor.

Comparative Examples 5 to 9 satisfied all manufacturing conditions suggested in the present disclosure but not the alloy composition. Comparative Example 10 is the case in which the alloying composition and the manufacturing conditions were not satisfied. Most of Comparative Examples 5 to 10 did not satisfy the target elongation, welded portion segregation index, impact energy, and the like, and had poor passability. Further, tearing or cracking occurred during the drawing process.

FIGS. 1 and 2 are photographic images of microstructures of Inventive Example 2 and Comparative Example 5; (a) is a photographic image of a flux-cored wire manufactured using Inventive Example 2 and Comparative Example 5 respectively, and (b) is an enlarged image of a sheath of (a). In the case of FIG. 1, the sheath was observed to be comparatively homogenized and accordingly capable of ensuring drawability. In contrast, it was observed in FIG. 2 that the sheath was not homogenized and it was difficult to ensure fine drawability.

As previously described, the alloying composition and the manufacturing conditions were appropriately controlled to significantly improve occurrence of segregation of the welded portion and reduce the alloying elements in the flux, thereby increasing an amount of the flux for weldability. This enabled obtaining of the cold rolled steel sheet for a flux-cred wire having excellent low temperature toughness and the weldability. Accordingly, use of the cold rolled steel sheet of the present disclosure can reduce an amount of the alloying element added in the flux, which may cause increased processing costs, and ensure stable workability of the welded member, thereby reducing occurrence of material deviations of products. It was effective in saving costs and improving workability.

While embodiments have been shown and described above, it will be apparent to those skilled in the art that modifications and variations could be made without departing from the scope of the present disclosure as defined by the appended claims.

The invention claimed is:

1. A cold rolled steel sheet for a flux-cored wire, comprising, by wt %:

0.035% to 0.10% of carbon (C), 0.05% to 0.25% of manganese (Mn), more than 0% and 0.05% or less of silicon (Si), 0.0005% to 0.01% of phosphorus (P), more than 0% and 0.008% or less of sulfur (S), 0.005% to 0.06% of aluminum (Al), 0.0005% to 0.003% of nitrogen (N), 0.8% to 1.7% of nickel (Ni), 0.1% to 0.5% of chromium (Cr), and a balance of iron (Fe) and inevitable impurities, and having 0.10 to 0.75 of $W_N$ defined by Relationship 1 below, $$W_N=(31\times C+0.5\times Mn+20\times Al)\times(Ni)\times(0.6\times Cr), \quad \text{Relationship 1}$$

where a unit for a content of each element in Relationship 1 is weight %, and wherein the cold rolled steel sheet has a segregation index of a welded portion that is less than 0.15%.

2. The cold rolled steel sheet of claim 1, wherein the cold rolled steel sheet has a microstructure consisting of, by area %, 1% to 6% of cementite and a balance of ferrite.

3. The cold rolled steel sheet of claim 1, wherein the cold rolled steel sheet has elongation of 40% or above.

4. The cold rolled steel sheet of claim 1, wherein the cold rolled steel sheet has an impact energy of 50 J or greater at −40° C.

5. The cold rolled steel sheet of claim 1, wherein the cold rolled steel sheet comprises 0.06 to 0.24% of manganese (Mn).

6. The cold rolled steel sheet of claim 1, wherein the cold rolled steel sheet comprises more than 0% and 0.04% or less of silicon (Si).

7. The cold rolled steel sheet of claim 1, wherein the cold rolled steel sheet comprises 0.001% to 0.009% of phosphorus (P).

8. The cold rolled steel sheet of claim 1, wherein the cold rolled steel sheet comprises more than 0% and 0.0075% or less of sulfur (S).

9. The cold rolled steel sheet of claim 1, wherein the cold rolled steel sheet comprises 0.007% to 0.05% of aluminum (Al).

10. The cold rolled steel sheet of claim 1, wherein the cold rolled steel sheet comprises 0.008% to 0.0029% of nitrogen (N).

11. The cold rolled steel sheet of claim 1, wherein the cold rolled steel sheet comprises 0.8% to 1.65% of nickel (Ni).

12. The cold rolled steel sheet of claim 1, wherein the cold rolled steel sheet comprises 0.13% to 0.45% of chromium (Cr).

13. A method for manufacturing the cold rolled steel sheet of claim 1 comprising:

heating a slab comprising, by wt %, 0.035% to 0.10% of carbon (C), 0.05% to 0.25% of manganese (Mn), more than 0% and 0.05% or less of silicon (Si), 0.0005% to 0.01% of phosphorus (P), more than 0% and 0.008% or less of sulfur (S), 0.005% to 0.06% of aluminum (Al), 0.0005% to 0.003% of nitrogen (N), 0.8% to 1.7% of nickel (Ni), 0.1% to 0.5% of chromium (Cr), and a balance of iron (Fe) and inevitable impurities, and having 0.10 to 0.75 of $W_N$ defined by Relationship 1 below to 1100° C. to 1300° C.;

hot rolling the heated slab such that a finish rolling temperature is 880° C. to 950° C. to obtain a hot rolled steel sheet;

coiling the heated hot rolled steel sheet in a temperature range of 550° C. to 700° C.;

cold rolling the coiled hot rolled steel sheet at a rolling reduction ratio of 50% to 85% to obtain a cold rolled steel sheet; and continuously annealing the cold rolled steel sheet in a temperature range of 700° C. to 850° C., $$W_N=(31\times C+0.5\times Mn+20\times Al)\times(Ni)\times(0.6\times Cr), \quad \text{Relationship 1}$$

where a unit for a content of each element in Relationship 1 is weight %.

14. The manufacturing method of claim 13, further comprising pickling the coiled hot rolled steel sheet before the cold rolling.

15. The manufacturing method of claim 13, further comprising skin-pass rolling the continuously annealed cold rolled steel sheet.

* * * * *